US011197357B1

(12) United States Patent
Steiner et al.

(10) Patent No.: US 11,197,357 B1
(45) Date of Patent: Dec. 7, 2021

(54) METHODS OF SERIALLY TRANSMITTING DATA TO A STRING OF LEDS USING RANDOM DELAY TIMES AND RELATED COMPUTER PROGRAM PRODUCTS

(71) Applicant: Toshiba Global Commerce Solutions Holdings Corporation, Tokyo (JP)

(72) Inventors: David Steiner, Durham, NC (US); Timothy Wayne Crockett, Raleigh, NC (US)

(73) Assignee: Toshiba Global Commerce Solutions Holdings Corporation

( * ) Notice: Subject to any disclaimer, the term of this patent is extended or adjusted under 35 U.S.C. 154(b) by 2 days.

(21) Appl. No.: 17/002,484

(22) Filed: Aug. 25, 2020

(51) Int. Cl.
*H05B 45/32* (2020.01)
*H05B 45/48* (2020.01)
*H05B 47/18* (2020.01)

(52) U.S. Cl.
CPC ..... *H05B 45/32* (2020.01); *H05B 45/48* (2020.01)

(58) Field of Classification Search
None
See application file for complete search history.

(56) References Cited

U.S. PATENT DOCUMENTS

2013/0216235 A1* 8/2013 Ishida ..... H04L 25/14 398/130

FOREIGN PATENT DOCUMENTS

WO WO-2010100982 A1 * 9/2010 ..... G09G 3/2096

OTHER PUBLICATIONS

Keith Szoulusha; *LED Driver with Integrated Spread Spectrum Reduces EMI without Adding Flicker*; Journal of Analog Inovation; Oct. 2013; pp. 12-14.

Harlyawan et al. *The Effects of Spread Spectrum Techniques in Mitigating Conducted EMI to LED Luminance*; International Journal of Electrical and Computer Engineering, vol. 6, No. 3; Jun. 2016; pp. 1332-1343.

Chip-on-Top SMD Type LED; SK6812RGBW-BW; Shenzhen Normand Electronic Co., Ltd.; Document No. SPC/SK6812RGBW-BW; Jan. 21, 2019; pp. 1-23.

* cited by examiner

*Primary Examiner* — Dedei K Hammond
(74) *Attorney, Agent, or Firm* — Stanek Lemon Crouse & Meeks, P.A.

(57) ABSTRACT

A method of transmitting data serially can be provided by generating a pulse for a current data bit on an electrical conductor coupled to a string of LEDs, where the pulse has a pulse duration that is defined by a time between a rising edge of the current data bit and a falling edge of the current data bit, that is based on a logical value of the current data bit. A random delay time can be introduced between the falling edge of the current data bit and a rising edge of the next data bit and then the rising edge of the next data bit can be generated after expiration of the random delay time.

20 Claims, 6 Drawing Sheets j={0, 31,2, 33, 4, 35, 6, 37, 8, 39, 10, 41, 12, 43, 14, 45, 16, 47, 18, 49, 20, 51, 22, 53, 24, 55, 26, 57, 28, 59, 30, 61, 32,
33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 0}

FIG. 6

METHODS OF SERIALLY TRANSMITTING DATA TO A STRING OF LEDS USING RANDOM DELAY TIMES AND RELATED COMPUTER PROGRAM PRODUCTS

FIELD

The present invention relates to the field of serial data transmission.

BACKGROUND

It is known to serially transmit data to a string of LEDs using a unipolar zeroing code protocol as discussed, for example, in the specification for smart LED controller SK6812RGBW-BW marketed by Shenzhen Normand Electronic Co., Ltd.

SUMMARY

Embodiments according to the invention can provide methods of serially transmitting data to a string of LEDs using random delay times and related computer program products. Pursuant to these embodiments, a method of transmitting data serially can be provided by generating a pulse for a current data bit on an electrical conductor coupled to a string of LEDs, where the pulse has a pulse duration that is defined by a time between a rising edge of the current data bit and a falling edge of the current data bit, that is based on a logical value of the current data bit. A random delay time can be introduced between the falling edge of the current data bit and a rising edge of the next data bit and then the rising edge of the next data bit can be generated after expiration of the random delay time.

BRIEF DESCRIPTION OF THE DRAWINGS

FIG. 6 is a schematic representation of a delay table that is configured to store random delay time values accessed by a processor circuit for introduction of random delay times into serial transmission of data to an LED string to reduce EMI in some embodiments according to the invention.

DETAILED DESCRIPTION OF EMBODIMENTS ACCORDING TO THE INVENTION

Figure 1:
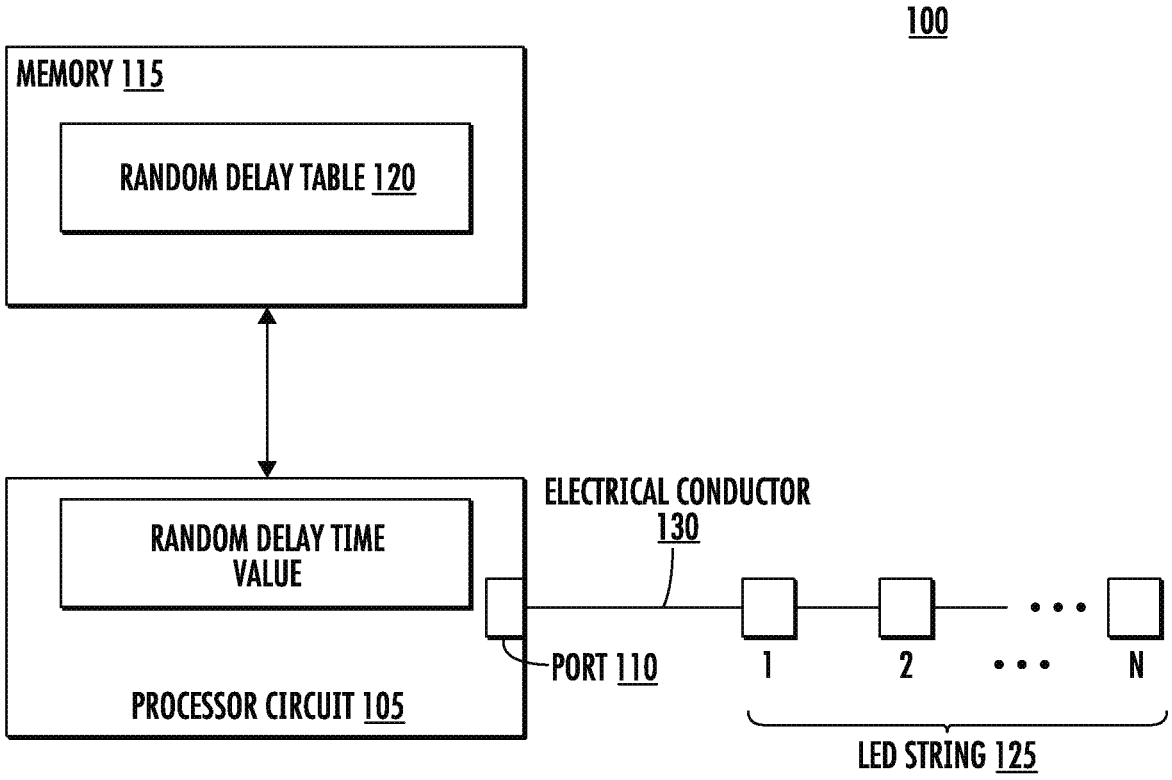
FIG. 1 is a block diagram of a serial data transmission system including a processor circuit couple to a memory including a delay table that is configured to store random delay time values used to introduce random delay times into serial transmission of data to an LED string to reduce EMI in some embodiments according to the invention.

As appreciated by the present inventors, some serial data transmission systems, such as one that uses a unipolar zeroing code protocol, can generate significant EMI due to a repeating alignment of fast signal edges. For example, a system that operates a string of individually addressable LEDs (such as SK6812RGBW LEDs) via single wire asynchronous serial communications using the unipolar zeroing code protocol, can generate a measurable amount of EMI due to repeated edge alignment.

In particular, a controller in such a configuration can send 4 bytes of serial data for each LED in the string). Accordingly, the controller operating a string of 100 LEDs would transmit 400 bytes of serially shifted data. Each particular LED in the string would remove the respective 4 bytes addressed to that particular LED and then transmit any remaining bytes to the next LED in the string. Therefore, in an LED string with N LEDs, the relatively short pulse widths used for data (e.g., 300 ns to 600 ns) coupled with the fact that each data pulse is repeated $16(N^2)+16(N)$ times creates significant EMI activity each time new data is transmitted to the string.

As further appreciated by the present inventors, as the update rate increases the EMI noise may also increase. For example, the EMI peak for an LED string of 66 SK6812RGBW LEDs operating at a pulse repetition rate of 833 kHz and at a refresh rate of 55 Hz was measured to be about 42.56 dBuV/m.

As appreciated by the present inventors, the EMI activity described above can be reduced by introducing random delay times into the data transmission, while also maintaining the fixed time intervals assigned each data value. In particular, the random delay times can be introduced into the transmission of a data bit after expiration of the fixed time interval for transmission of the data by keeping the voltage level low for an additional random delay time. However, the additional random delay time added to the fixed time interval for the data bit is limited so that the longest time for which the voltage level is kept low is less than the protocol specified time that is needed to perform an execute instruction.

In some embodiments, the additional random delay time added to the fixed time interval for the data bit is limited to a time so that the entire time for which the voltage is kept low continuously is less than 80 us. In some embodiments, the additional random delay time added to the fixed time interval for the data bit is limited to a time so that the entire time for which the voltage is kept low continuously is less than 64 us.

In some embodiments, a random delay time can be provided for each data byte to be transmitted and that same random delay time can be introduced after each data bit fixed time interval transmitted as part of the byte. In some embodiments, a random delay time can be provided for each data bit to be transmitted so that a different random delay time can be introduced after each data bit fixed time interval transmitted as part of the byte. In some embodiments according to the present invention, a delay table can be created and populated with random delay time values that are selected to reduce EMI. During operation, the processor circuit operating under software control can execute instructions to access the random delay time values in the table, for use in generating the random delay time, by for example, stalling data transmission after the data bit fixed time interval by a number of operation indicated by the random delay time value.

In still further embodiments, the processor circuit operates at speed sufficient to allow the random delay times to be generated using a local pseudo-random number generator function on-demand so that the delay table may not be needed. During operation, the processor circuit operating under software control can execute instructions to create the random delay time, by for example, stalling data transmission after the data bit fixed time interval by a number of operation indicated by the random delay time value.

In some embodiments according to the invention, the EMI peak for an LED string of 66 SK6812RGBW LEDs operating at a pulse repetition rate of 833 kHz and at a refresh rate of 55 Hz according to the invention was measured to be about 30.8 dBuV/m.

FIG. 1 is a block diagram of a serial data transmission system 100 including a processor circuit 105 couple to a memory 115 including a random delay table 120 that is configured to store random delay time values used to introduce random delay times into the serial transmission of data to an LED string 125 to reduce EMI in some embodiments according to the invention.

According to FIG. 1, the random delay table 120 can be created by the processor circuit 105 and populated with random delay time values that are selected to reduce EMI. It will be understood that the table shown in FIG. 6 is a representation of the random delay table 120 that is configured to store the random delay time values accessed by the processor circuit 105 for introduction of the random delay times into the serial transmission of data to the LED string 130 in some embodiments.

During operation, the processor circuit 105 operating under software control can execute instructions stored in the memory 115 to access the random delay time values stored in the table 120, for use in generating the random delay time, by for example, stalling data transmission after the data bit fixed time interval by a number of operations or cycles indicated by the random delay time value to introduce the random delay time.

In operation, the processor circuit 105 operating under software control can execute instructions stored in the memory 115 to generate a data pulse representing data on an electrical conductor 130 that is coupled to the LED string 125. The processor circuit 105 generates the data pulse by controlling a port 110 of the processor circuit 105 to create a rising edge of the data pulse which stays high for a time and is followed by a falling edge of the data pulse which is held low for the data bit fixed time interval to signal the value of the data.

At the end of the data bit fixed time interval, the processor circuit 105 causes the port 110 output to stay low for the additional random delay time accessed in the random delay table 120. After the expiration of the random delay time for the current data bit, the processor circuit 105 starts the transmission of the next data bit by causing the port 110 output to go high to provide the rising edge of the next data bit.

Figure 2:
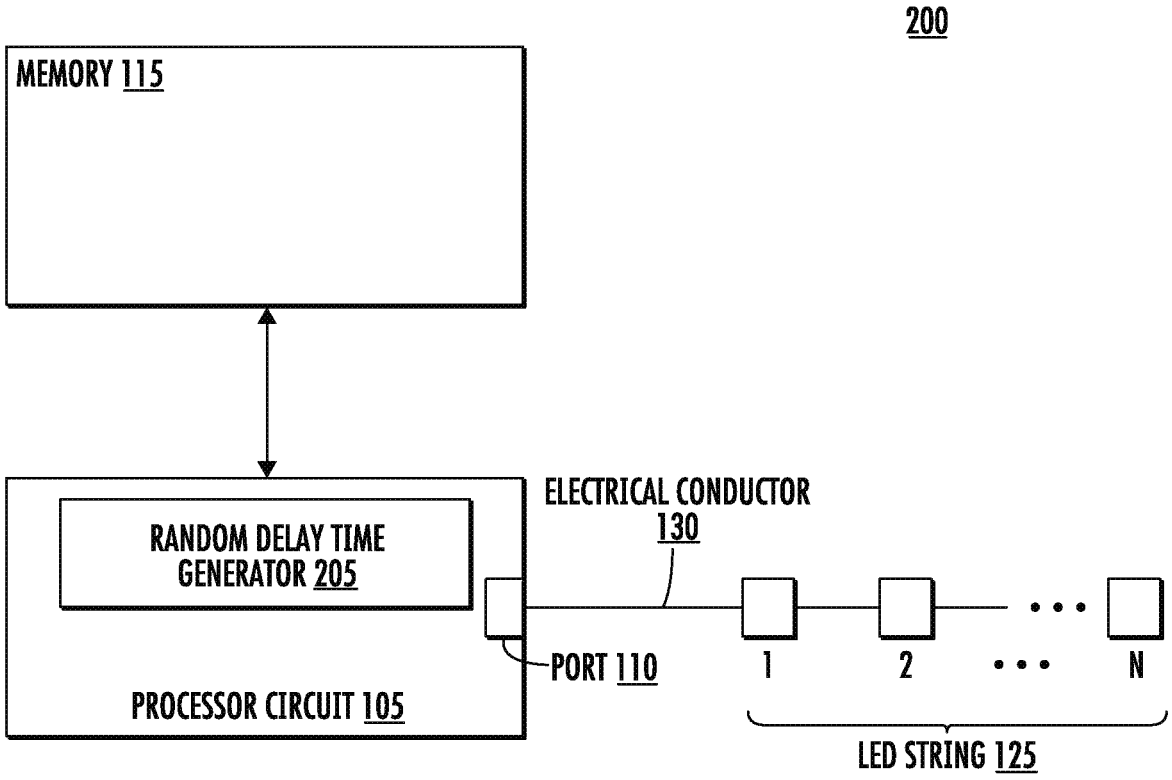
FIG. 2 is a block diagram of a serial data transmission system including a processor circuit coupled to a memory configured to introduce random delay times into serial transmission of data to an LED string to reduce EMI in some embodiments according to the invention.

FIG. 2 is a block diagram of a serial data transmission system including a processor circuit couple to a memory configured to introduce random delay times into serial transmission of data to an LED string to reduce EMI in some embodiments according to the invention.

According to FIG. 2, the processor circuit 105 operates at a speed sufficient to allow the random delay times to be generated dynamically using a local pseudo-random number generator function on-demand so that the delay table may not be needed. During operation, the processor circuit 105 operating under software control can execute instructions stored in the memory 115 to create the random delay times by, for example, stalling data transmission after the data bit fixed time interval by a number of operations or cycles indicated by the random delay time value to provide the random delay time.

Figure 3:
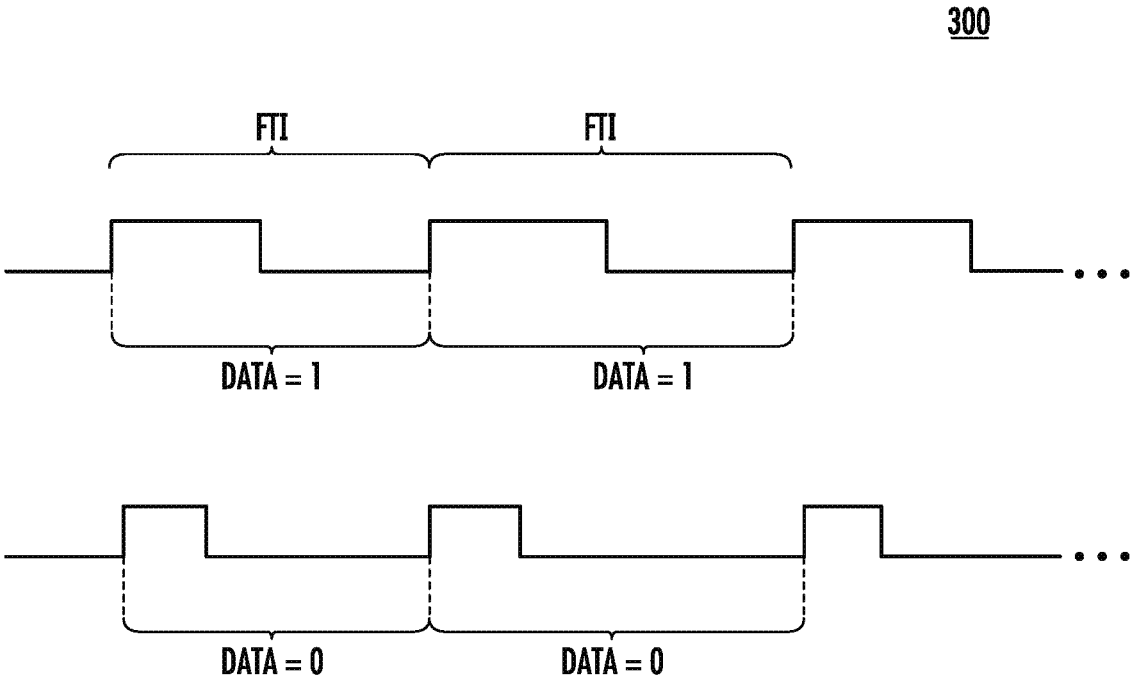
FIG. 3 is a timing diagram showing serial data transmission using a zeroing code protocol to provide a series of first pulses for data 1 using a fixed time interval and a series of second pulses for data 0 using the fixed time interval.

FIG. 3 is a timing diagram 300 showing serial data transmission using a zeroing code protocol to provide a series of first pulses for data 1 using a fixed time interval and a series of second pulses for data 0 using the fixed time interval. According to FIG. 3, two transmission stream are shown: the upper timing diagram illustrating the transmission of two data bits of value "1" and the lower timing diagram illustrating the transmission of two data bits of value "0".

As shown in FIG. 3, the fixed time interval for the transmission of data=1 and the fixed time interval for the transmission of data=0 are equal. For example, in some embodiments, the data pulse for data=1 can be about 600 ns and the low-going portion after the falling edge of the data pulse until the next rising edge can be about 600 ns so that the fixed time interval for data=1 is about 1200 ns. In contrast, the data pulse for data=0 can be about 300 ns and the low-going portion after the falling edge of the data pulse until the next rising edge can be about 900 ns so that the fixed time interval for data=0 is also about 1200 ns.

Moreover, as also shown in FIG. 3, subsequent data bit transmission (for data=1 and data=0) results in the repetition of the same edges at the same boundaries (e.g. about 1200 ns) for an extended period. Still further, FIG. 3 shows that no random delay time is introduced after the fixed time interval for either data=1 or data=0.

Figure 4:
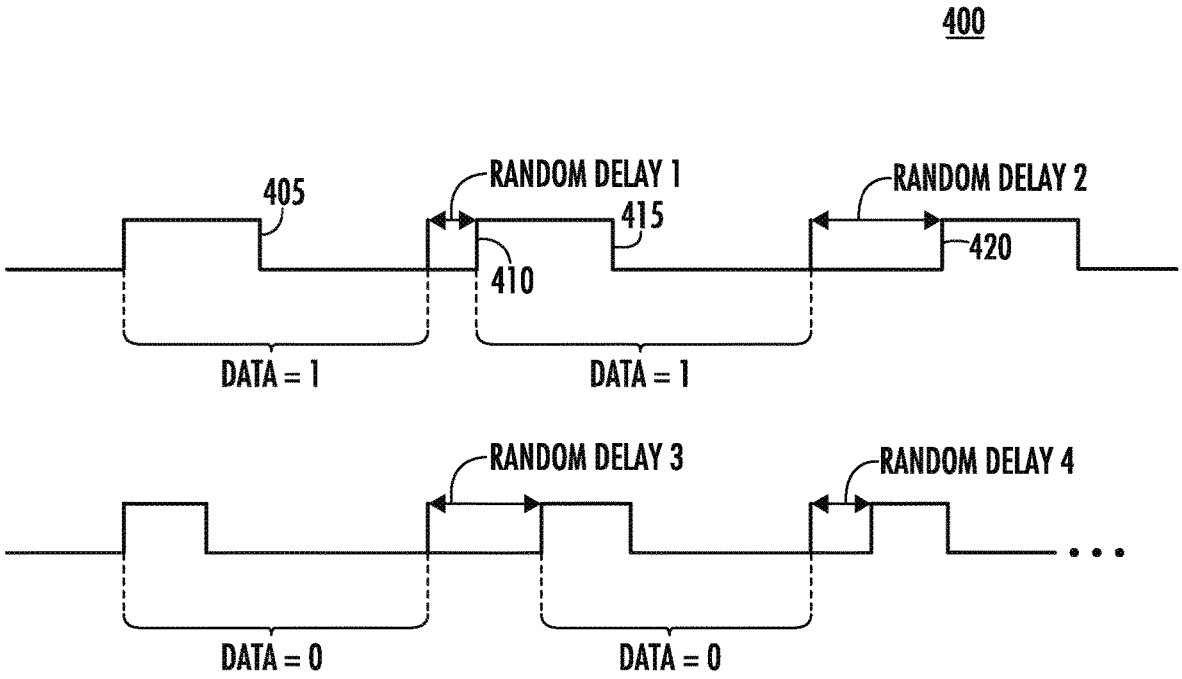
FIG. 4 is a timing diagram showing serial data transmission using a series of first pulses for data 1 including random delay times between each pulse and a series of second pulses for data 0 including random delay times between each pulse in some embodiments according to the invention.

FIG. 4 is a timing diagram 400 showing serial data transmission using a series of first pulses for data 1 including random delay times 1-2 between adjacent pulses and a series of second pulses 3-4 for data 0 including random delay times between each adjacent pulse in some embodiments according to the invention. According to FIG. 4, as described above the fixed time interval for the transmission of data=1 and the fixed time interval for the transmission of data=0 are equal. For example, in some embodiments, the data pulse for data=1 can be about 600 ns and the low-going portion after the falling edge of the data pulse until the next rising edge can be about 600 ns so that the fixed time interval for data=1 is about 1200 ns. In contrast, the data pulse for data=0 can be about 300 ns and the low-going portion after the falling edge of the data pulse until the next rising edge can be about 900 ns so that the fixed time interval for data=0 is also about 1200 ns.

In contrast to FIG. 3, however, the processor circuit operates to introduce the random delay time after the fixed time interval for each data bit. It will be understood that the processor circuit 105 can cause the port 110 output to stay low after the fixed time interval for the additional random delay time accessed in the random delay table 120. After the expiration of the random delay time for the current data bit (0 or 1), the processor circuit 105 starts the transmission of the next data bit by causing the port 110 output to go high to provide the rising edge of the next data bit.

In operations according to FIG. 4, the processor circuit can determine the random delay time (either on a per bit basis or on a per byte basis) and continue to hold the port output low for the determined random delay time, after which the next data bit can begin transmission. Accordingly in some embodiments according to the invention, the time between transmitting data bits can be extended by the random delay time. For example, in some embodiments according to the invention as illustrated by using the random delay time values shown in the table of FIG. 6, can be equal to the fixed time interval for a data bit (e.g., 1200 ns) plus the random delay time determined for use in transmitting the current data bit (e.g., about 0 us to about 62 us using the random delay time values of FIG. 6), It will be understood that other random delay values may be used. However, the determined random delay time should not cause the port to be held low for a continuous time that greater than or equal to the time specified by the protocol for the LEDs in the string to execute an instruction.

Figure 5:
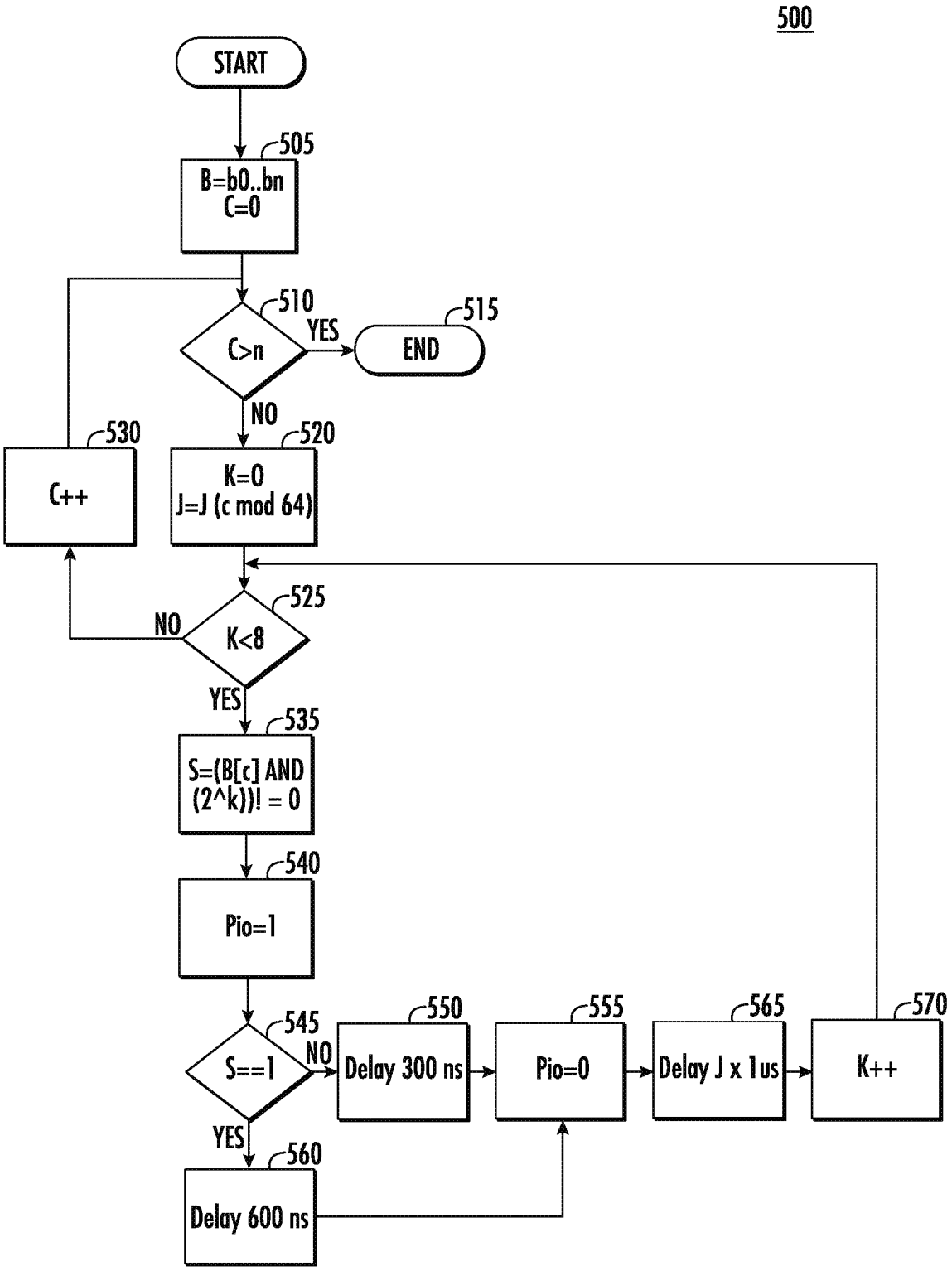
FIG. 5 is a flowchart illustrating operations of a serial data transmission system configured to introduce random delay times into serial transmission of data to an LED string to reduce EMI in some embodiments according to the invention.

FIG. 5 is a flowchart 500 illustrating operations of the serial data transmission system configured to introduce random delay times into the serial transmission of data to an LED string to reduce EMI in some embodiments according to the invention. In particular, the operation illustrated in FIG. 5 uses the same fixed time interval and data pulse values as those described in FIG. 4.

According to FIG. 5, operations begin at block 505 wherein the random delay table is accessed by the processor circuit, the byte counter C is initialized, and the data bytes B to be transmitting are accessed. It will be understood that the random delay table can be the table shown in FIG. 6 that includes 64 random values which can be used by the processor circuit to generate a random delay time in microseconds by multiplying the random delay value accessed from the table by 1 us.

Still referring to FIG. 5, operations continue by determining whether the current value of the byte counter C indicates that all bytes have been transmitted (block 510) if all bytes have not been transmitted, operations continue at block 520 whereby the bit counter K is initialized to zero and the random delay table is accessed to retrieve a random delay time value which is stored as J. The processor circuit then determines whether all bits of the current byte have been transmitted (block 525), if all of the bits in the current byte have been transmitted (block 525), operations continue by incrementing the byte counter C (block 530) whereby operations continue at block 510.

Still referring to FIG. 5, if all bits of the current byte have not been transmitted (block 525), it is determined whether the current bit is equal to a one or zero (block 535) and subsequently the processor circuit sets the output port to a high voltage level (block 540). Next, the processor circuit determines whether the value of the current bit is equal to a one (block 545). If the current data bit is not equal to 1 (block 545), a delay of 600 nanoseconds is provide during which the port output remains high (block 560) and then operations continue at block 555 where the output port voltage level is returned to zero at the end of the 600 nanosecond delay.

If, however, the current data bit is not equal to 1 (block 545) the processor circuit keeps the port output at the high level for 300 nanoseconds (block 550) after which the processor circuit brings the output port low (block 555). Subsequent to either the current data bit being 1 or 0, the processor circuit then provides the random delay time by multiplying the accessed random delay time value J by 1 us. The processor circuit then holds the output of the port low the random delay time (block 565) and then the bit counter K is incremented and operations continue at block 525.

FIG. 6 is a schematic representation of a delay table that is configured to store random delay time values accessed by a processor circuit for introduction of random delay times into serial transmission of data to an LED string to reduce EMI in some embodiments according to the invention.

As described herein, as appreciated by the present inventors, the EMI activity described above can be reduced by introducing random delay times into the data transmission, while also maintaining the fixed time intervals assigned each data value. In particular, the random delay times can be introduced into the transmission of a data bit after expiration of the fixed time interval for transmission of the data by keeping the voltage level low for an additional random delay time. However, the additional random delay time added to the fixed time interval for the data bit is limited so that the longest time for which the voltage level is kept low less than the protocol specified time that is needed to perform an execute instruction. In some embodiments, the additional random delay time added to the fixed time interval for the data bit is limited to a time so that the entire time for which the voltage is kept low continuously is less than 80 us. In some embodiments, the additional random delay time added to the fixed time interval for the data bit is limited to a time so that the entire time for which the voltage is kept low continuously is less than 64 us.

The processor circuits and memories described herein are examples of portions of systems upon which one or more aspects of embodiments of the present invention can be implemented. For example the processor circuits and memories of FIGS. 1 and 2 illustrates a computing system that can be used to perform processor-executable instructions represented by non-transitory processor-readable media to carry out the operations described herein including those illustrated in FIGS. 4 and 5 in some embodiments according to the invention.

Examples of processor circuit can include logic, one or more components, circuits (e.g., modules), or mechanisms. Circuits are tangible entities configured or programmed to perform certain operations. In an example, processor circuits can be arranged (e.g., internally or with respect to external entities such as other circuits) in a specified manner. In an example, one or more processor circuits can be configured by software (e.g., instructions, an application portion, or an application) as a circuit that operates to perform certain operations as described herein. In an example, the software can reside (1) on a non-transitory machine readable medium (such as a memory) or (2) in a transmission signal.

In an example, a circuit can be implemented mechanically or electronically. For example, a circuit can comprise dedicated circuitry or logic that is specifically configured to perform one or more techniques such as discussed above, such as including a special-purpose processor, a field programmable gate array (FPGA) or an application-specific integrated circuit (ASIC). In an example, a circuit can comprise programmable logic (e.g., circuitry, as encompassed within a general-purpose processor or other programmable processor) that can be temporarily configured (e.g., by software) to perform the certain operations. It will be appreciated that the decision to implement a circuit mechanically (e.g., in dedicated and permanently configured circuitry), or in temporarily configured circuitry (e.g., configured by software) can be driven by cost and time considerations.

Accordingly, the term "circuit" is understood to encompass a tangible entity, be that an entity that is physically constructed, permanently configured (e.g., hardwired), or temporarily (e.g., transitorily) configured (e.g., programmed) to operate in a specified manner or to perform specified operations. In an example, given a plurality of temporarily configured circuits, each of the circuits need not be configured or instantiated at any one instance in time. For example, where the circuits comprise a general-purpose processor configured via software, the general-purpose processor can be configured as respective different circuits at different times. Software can accordingly configure a processor circuit, for example, to constitute a particular circuit at one instance of time and to constitute a different circuit at a different instance of time In an example, processor circuits can provide information to, and receive information from, other circuits. In this example, the processor circuits can be regarded as being communicatively coupled to one or more other circuits. Where multiple of such circuits exist contemporaneously, communications can be achieved through signal transmission (e.g., over appropriate circuits and buses) that connect the circuits. In embodiments in which multiple circuits are configured or instantiated at different times, communications between such circuits can be achieved, for example, through the storage and retrieval of information in memory structures to which the multiple circuits have access. For example, one processor circuit can perform an operation and store the output of that operation in a memory device to which it is communicatively coupled. A further processor circuit can then, at a later time, access the memory device to retrieve and process the stored output. In an example, circuits can be configured to initiate or receive communications with input or output devices and can operate on a resource (e.g., a collection of information).

The various operations of method examples described herein can be performed, at least partially, by one or more processors that are temporarily configured (e.g., by software) or permanently configured to perform the relevant operations. Whether temporarily or permanently configured, such processors can constitute processor-implemented circuits that operate to perform one or more operations or functions. In an example, the circuits referred to herein can comprise processor-implemented circuits.

Similarly, the methods described herein can be at least partially processor-implemented. For example, at least some of the operations of a method can be performed by one or processors or processor-implemented circuits. The performance of certain of the operations can be distributed among the one or more processors, not only residing within a single machine, but deployed across a number of machines.

Example embodiments (e.g., apparatus, systems, or methods) can be implemented in digital electronic circuitry, in computer hardware, in firmware, in software, or in any combination thereof. Example embodiments can be implemented using a computer program product (e.g., a computer program, tangibly embodied in an information carrier or in a machine readable medium, for execution by, or to control the operation of, data processing apparatus such as a programmable processor, a computer, or multiple computers).

A computer program can be written in any form of programming language, including compiled or interpreted languages, and it can be deployed in any form, including as a stand-alone program or as a software module, subroutine, or other unit suitable for use in a computing environment. A computer program can be deployed to be executed on one computer or on multiple computers at one site or distributed across multiple sites and interconnected by a communication network.

In an example, operations can be performed by one or more programmable processor circuits executing a computer program to perform functions by operating on input data and generating output. Examples of method operations can also be performed by, and example apparatus can be implemented as, special purpose logic circuitry (e.g., a field programmable gate array (FPGA) or an application-specific integrated circuit (ASIC)).

Some of the systems described herein, such as the edge device integration system 125 can include clients and servers. A client and server are generally remote from each other and generally interact through a communication network. The relationship of client and server arises by virtue of computer programs running on the respective computers and having a client-server relationship to each other. In embodiments deploying a programmable computing system, it will be appreciated that both hardware and software architectures require consideration. Specifically, it will be appreciated that the choice of whether to implement certain functionality in permanently configured hardware (e.g., an ASIC), in temporarily configured hardware (e.g., a combination of software and a programmable processor), or a combination of permanently and temporarily configured hardware can be a design choice. Below are set out hardware (e.g., machine 400) and software architectures that can be deployed in example embodiments.

In a networked deployment, the system can operate in the capacity of either a server or a client machine in server-client network environments. In an example, processor circuit can act as a peer machine in peer-to-peer (or other distributed) network environments. The processor circuit can be a (or included in) personal computer (PC), a tablet PC, a set-top box (STB), a Personal Digital Assistant (PDA), a mobile telephone, a web appliance, a network router, switch or bridge, or any machine capable of executing instructions (sequential or otherwise) specifying actions to be taken (e.g., performed) by the machine 400. Further, while only a single processor circuit is illustrated, the term "machine" shall also be taken to include any collection of machines that individually or jointly execute a set (or multiple sets) of instructions to perform any one or more of the methodologies discussed herein.

The machine readable medium described herein can include a single medium or multiple media (e.g., a local memory closely coupled to the processor circuit, a centralized or distributed database, and/or associated caches and servers) that configured to store the one or more instructions. The term "machine readable medium" can also be taken to include any tangible medium that is capable of storing, encoding, or carrying instructions for execution by the machine and that cause the machine to perform any one or more of the methodologies of the present disclosure or that is capable of storing, encoding or carrying data structures utilized by or associated with such instructions. The term "machine readable medium" can accordingly be taken to include, but not be limited to, solid-state memories, and optical and magnetic media. Specific examples of machine readable media can include non-volatile memory, including, by way of example, semiconductor memory devices (e.g., Electrically Programmable Read-Only Memory (EPROM), Electrically Erasable Programmable Read-Only Memory (EEPROM)) and flash memory devices; magnetic disks such as internal hard disks and removable disks; magneto-optical disks; and CD-ROM and DVD-ROM disks.

The instructions can further be transmitted or received over a communications network using a transmission medium via the network interface device utilizing any one of a number of transfer protocols (e.g., frame relay, IP, TCP, UDP, HTTP, etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., IEEE 802.11 standards family known as Wi-Fi®, IEEE 802.16 standards family known as WiMax®), peer-to-peer (P2P) networks, among others. The term "transmission medium" shall be taken to include any intangible medium that is capable of storing, encoding or carrying instructions for execution by the machine, and includes digital or analog communications signals or other intangible medium to facilitate communication of such software.

The terminology used herein is for the purpose of describing particular embodiments only and is not intended to be limiting to other embodiments. As used herein, the singular forms "a", "an" and "the" are intended to include the plural forms as well, unless the context clearly indicates otherwise. It will be further understood that the terms "comprises," "comprising," "includes" and/or "including", "have" and/or "having" when used herein, specify the presence of stated features, integers, steps, operations, elements, and/or components, but do not preclude the presence or addition of one or more other features, integers, steps, operations, elements, components, and/or groups thereof. Elements described as being "to" perform functions, acts and/or operations may be configured to or other structured to do so.

Unless otherwise defined, all terms (including technical and scientific terms) used herein have the same meaning as commonly understood by one of ordinary skill in the art to which various embodiments described herein belong. It will be further understood that terms used herein should be interpreted as having a meaning that is consistent with their meaning in the context of this specification and the relevant art and will not be interpreted in an idealized or overly formal sense unless expressly so defined herein.

As will be appreciated by one of skill in the art, various embodiments described herein may be embodied as a method, data processing system, and/or computer program product. Furthermore, embodiments may take the form of a computer program product on a tangible computer readable storage medium having computer program code embodied in the medium that can be executed by a computer.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wired, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages, such as a programming language for a FPGA, Verilog, System Verilog, Hardware Description language (HDL), and VHDL. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computer environment or offered as a service such as a Software as a Service (SaaS).

Some embodiments are described herein with reference to flowchart illustrations and/or block diagrams of methods, systems and computer program products according to embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall support claims to any such combination or subcombination.

While the foregoing is directed to aspects of the present disclosure, other and further embodiments of the disclosure may be devised without departing from the basic scope thereof, and the scope thereof is determined by the claims that follow.

What is claimed:

1. A method of transmitting data serially, the method comprising:

(a) accessing a delay table including a plurality of random delay time values configured for use as a random delay time between a falling edge of a current data bit and a rising edge of a next data bit to reduce electromagnetic interference as part of serial transmission of a plurality of data bytes including the current data bit and the next data bit on an electrical conductor that is electrically coupled to a string of LEDs;

(b) generating a pulse for the current data bit on the electrical conductor, the pulse having a pulse duration that is defined by a time between a rising edge of the current data bit and the falling edge of the current data bit, that is based on a logical value of the current data bit;

(c) selecting one of the plurality of random delay time values from the delay table for generation of the random delay time introduced between the falling edge of the current data bit and the rising edge of the next data bit; and then (d) generating the rising edge of the next data bit after expiration of the random delay time.

2. The method of claim 1 wherein the pulse duration for the current data bit comprises a first fixed time interval for a logical 0 value and the pulse duration for the current data bit comprises a second fixed time interval, that is about twice the first fixed time interval, for a logical 1 value.

3. The method of claim 2 wherein the pulse duration for the current data bit is followed by a low voltage level lasting for a third fixed time interval wherein the first fixed time interval and the third fixed time interval equals a logical 0 bit time; and wherein the pulse duration for the current data bit is followed by the low voltage level lasting for a fourth fixed time interval wherein the second fixed time interval and the fourth fixed time interval equals a logical 1 bit time.

4. The method of claim 1 wherein the falling edge of the current data bit to the rising edge of the next data bit is greater than about 900 ns and less than about 80 microseconds for a logical 0 value and the falling edge of the current data bit to the rising edge of the next data bit is greater than about 600 ns and less than about 80 microseconds for a logical 1 value.

5. The method of claim 1 further comprising:

repeating operations (b) through (d) for each data bit transmitted on the electrical conductor.

6. The method of claim 5 wherein selecting one of the plurality of random delay time values from the delay table comprises selecting the random delay time value sequentially from the delay table to provide the random delay times for operation (g) for use with each data bit within a respective data by that transmitted on the electrical conductor.

7. The method of claim 5 wherein selecting one of the plurality of random delay time values from the delay table comprises sequentially selecting the one of the plurality of random delay time values for use with all data bits in a respective data byte transmitted on the electrical conductor.

8. A method of transmitting data serially, the method comprising:

determining a plurality of random delay time values configured for use as a random delay time between a falling edge of a current data bit and a rising edge of a next data bit to reduce electromagnetic interference generated as part of serial transmission of a plurality of data bytes including the current data bit and the next data bit on an electrical conductor that is electrically coupled to a string of LEDs; and configuring a delay table including the plurality of random delay time values.

9. The method of claim 8 further comprising:

(a) generating a pulse for the current data bit on the electrical conductor, the pulse having a pulse duration that is defined by a time between a rising edge of the current data bit and the falling edge of the current data bit, that is based on a logical value of the current data bit;

(b) selecting one of the plurality of random delay time values from the delay table for generation of the random delay time introduced between the falling edge of the current data bit and the rising edge of the next data bit; and then (d) generating the rising edge of the next data bit after expiration of the random delay time.

10. The method of claim 9 further comprising:

repeating operations (a) and (b) for each data bit transmitted on the electrical conductor.

11. A method of transmitting data serially, the method comprising:

generating a pulse for a current data bit on an electrical conductor coupled to a string of LEDs, the pulse having a pulse duration that is defined by a time between a rising edge of the current data bit and a falling edge of the current data bit, that is based on a logical value of the current data bit;

introducing a random delay time between the falling edge of the current data bit and a rising edge of the next data bit; and then generating the rising edge of the next data bit after expiration of the random delay time.

12. The method of claim 11 further comprising:

dynamically generating the random delay time on a bit-by-bit basis.

13. The method of claim 11 further comprising:

dynamically generating the random delay time on a byte-by-byte basis.

14. The method of claim 11 further comprising:

generating the random delay time by accessing a delay table including a plurality of random delay time values pre-configured for sequential use as the random delay time to reduce electromagnetic interference generated by alignment of the falling edge and the rising edge as part of serial transmission of a plurality of data bytes including the current data bit and the next data bit on the electrical conductor; and introducing the random delay time comprises accessing the delay table to provide the random delay time.

15. The method of claim 11 wherein the pulse duration for the current data bit comprises a first fixed time interval for a logical 0 value and the pulse duration for the current data bit comprises a second fixed time interval, that is about twice as the first fixed time interval, for a logical 1 value.

16. The method of claim 15 wherein the pulse duration for the current data bit is followed by a low voltage level lasting for a third fixed time interval wherein the first fixed time interval and the third fixed time interval equals a logical 0 bit time; and wherein the pulse duration for the current data bit is followed by the low voltage level lasting for a fourth fixed time interval wherein the second fixed time interval and the fourth fixed time interval equals a logical 1 bit time.

17. A non-transitory computer-readable medium whose contents, when executed by a computing system, cause the computing system to perform operations for transmitting data serially comprising:

generating a pulse for a current data bit on an electrical conductor coupled to a string of LEDs, the pulse having a pulse duration that is defined by a time between a rising edge of the current data bit and a falling edge of the current data bit, that is based on a logical value of the current data bit;

introducing a random delay time between the falling edge of the current data bit and a rising edge of the next data bit; and then generating the rising edge of the next data bit after expiration of the random delay time.

18. The non-transitory computer-readable medium of claim 17 further comprising:

dynamically generating the random delay time on a bit-by-bit basis.

19. The non-transitory computer-readable medium of claim 17 further comprising:

dynamically generating the random delay time on a byte-by-byte basis.

20. The non-transitory computer-readable medium of claim 17 further comprising:

generating the random delay time by accessing a delay table including a plurality of random delay time values pre-configured for sequential use as the random delay time to reduce electromagnetic interference generated by alignment of the falling edge and the rising edge as part of serial transmission of a plurality of data bytes including the current data bit and the next data bit on the electrical conductor; and introducing the random delay time comprises accessing the delay table to provide the random delay time on a byte-by-byte basis.

* * * * *